US005191974A

United States Patent [19]

Saalman

[11] Patent Number: 5,191,974

[45] Date of Patent: Mar. 9, 1993

[54] SAFETY BOX

[76] Inventor: Marion J. Saalman, Rte. 2, Box 100, Tell City, Ind. 47586

[21] Appl. No.: 885,543

[22] Filed: May 19, 1992

[51] Int. Cl.[5] ..... A45C 11/32

[52] U.S. Cl. ..... 206/37.6; 206/37.4; 206/37.1; 206/1.5; 70/456 R

[58] Field of Search ..... 206/1.5, 37.1, 37.4, 206/37.6, 37.7, 37.8; 220/210; 312/114, 138.1, 216; 70/448, 451, 456 R, 459

[56] References Cited

U.S. PATENT DOCUMENTS

| | | | |
|---|---|---|---|
| 352,614 | 11/1886 | Fashing | 312/138.1 |
| 944,513 | 12/1909 | Selden | 312/216 |
| 2,485,051 | 10/1949 | Joslin | 70/456 R |
| 3,716,091 | 2/1973 | Gaines | 206/37.8 |
| 3,933,017 | 1/1976 | Shee | 70/456 R |
| 3,993,378 | 11/1976 | Berkus | 312/138.1 |
| 4,370,919 | 2/1983 | Wagner et al. | 220/210 |
| 4,660,902 | 4/1987 | Resendez, Jr. | 312/216 |
| 4,799;587 | 1/1989 | Desanto | 206/37.6 |
| 4,860,563 | 8/1989 | Gerch | 70/456 R |
| 4,895,253 | 1/1990 | Yaeger | 206/1.5 |

FOREIGN PATENT DOCUMENTS

| | | | |
|---|---|---|---|
| 2500326 | 7/1976 | Fed. Rep. of Germany | 70/456 R |
| 2040185 | 8/1978 | Fed. Rep. of Germany | 70/456 R |

*Primary Examiner*—David T. Fidei
*Attorney, Agent, or Firm*—Maurice L. Miller, Jr.

[57] ABSTRACT

A safety box having particular adaptability for use in connection with equipment maintenance and repair, achieving safety during service. The box is defined by a base and a lid, where a locking mechanism prevents access to the contents, as one or more keys, which control equipment functioning. In other words, importance lies in affording safety to personnel with equipment/machinery operation.

7 Claims, 1 Drawing Sheet

SAFETY BOX

BACKGROUND OF THE INVENTION

As is known, plant safety is an important factor in any given manufacturing operation. In this connection, and more particularly, importance lies in the knowledge that certain equipment remains in optimal operative condition, irrespective of whether or not certain components are in a repair stage and/or are contemplated for repair. The government, through OSHA, i.e. Occupational Safety & Health Administration, is placing an increasing number of restrictions, throughout industry, to achieve maximum safety for the workman.

One particular ground of concern is in connection with heavy machinery, where knowledge of other personnel involved in a repair/maintenance operation, or at least their presence, is known to fellow workers, i.e. where, for example, provision is made for absolute shut-off of particular equipment.

DESCRIPTION OF THE INVENTION

The invention achieves the latter objective by providing a safety box into which one or more keys are introduced and retained, where access to such is prohibited by a lid/cover which is locked into a closed position.

In other words, once a key or keys are placed within the safety box, being viewable through a window, an unauthorized worker cannot remove a key and initiate a repair activity unknown to another in the group. The locked key, for example, could be the sole cause of machine operation.

In the event the safety box is at a locked condition, openings are also provided around the peripheral edge of the lid, such evidencing, by a tag, the presence of others on the same project, but, perhaps, not viewable.

DESCRIPTION OF THE FIGURES

In any event, a better understanding of the present invention will become more apparent from the following description, taken in conjunction with the accompanying drawing, wherein.

Figure 3:
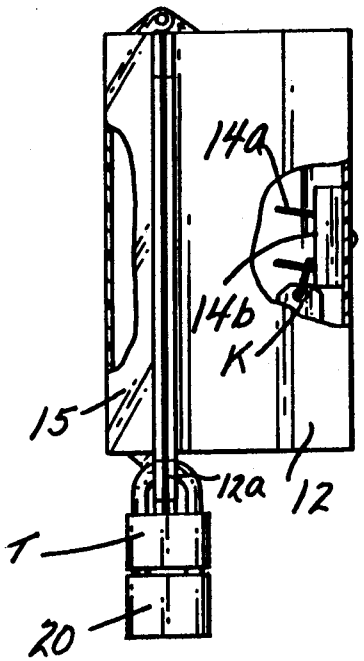
FIG. 3 is a view in side elevation, partly broken away, further detailing the safety box herein.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modification in the illustrated device, and such further applications of the principles of the invention as illustrated therein being contemplated as would normally occur to one skilled in the art to which the invention relates.

DESCRIPTION OF THE PREFERRED EMBODIMENT

As a matter of example, and with the considerable usage of heavy equipment at a manufacturing facility, equipment down time is not uncommon, being required for maintenance/repair and/or the like. Difficulty lies, however, in the instance where large machinery if involved, such as that taking a great deal of floor space. Without some sort of safety provision, it is oftentimes difficult to visually notice a repair person, as, by reason of obstructions.

OSHA, for example, has developed, and/or is developing and/or is desirous for a provision controlling equipment access. The safety box of the invention satisfies such needs, being in the form of a base 12 to which a hinged lid 15 is secured.

In the preferred embodiment, the base 12, in the form of a cavity, contains a series of hooks **14*a* on an internal support member 14*b*. The hooks 14*a* may be straight and angle upwardly, as in FIG. 3**, or could be more conventional in configuration.

Figure 1:
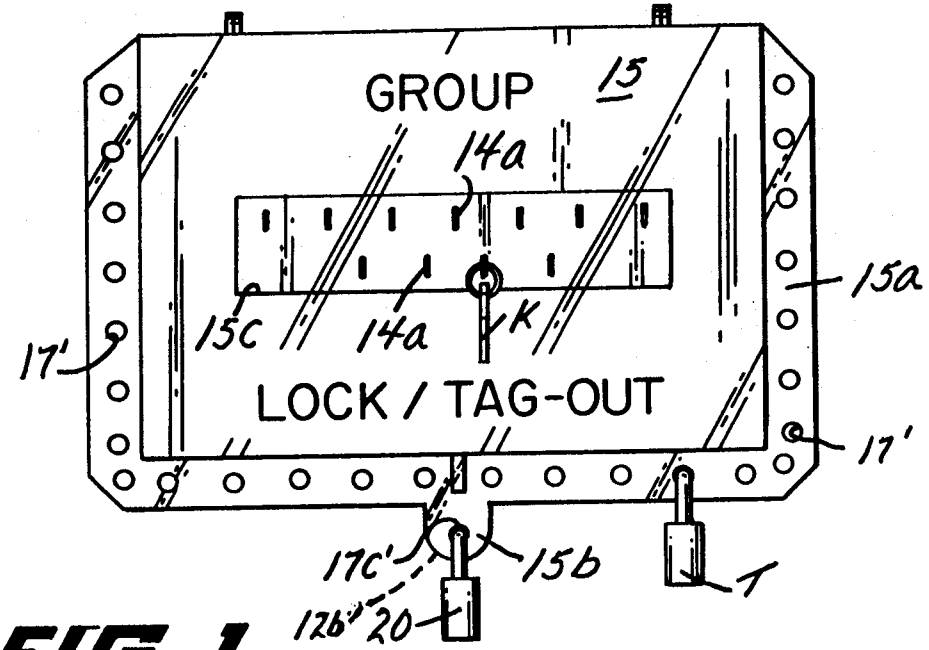
FIG. 1 is a view in front elevation showing a safety box in accordance with the teachings of the present invention.
Figure 2:
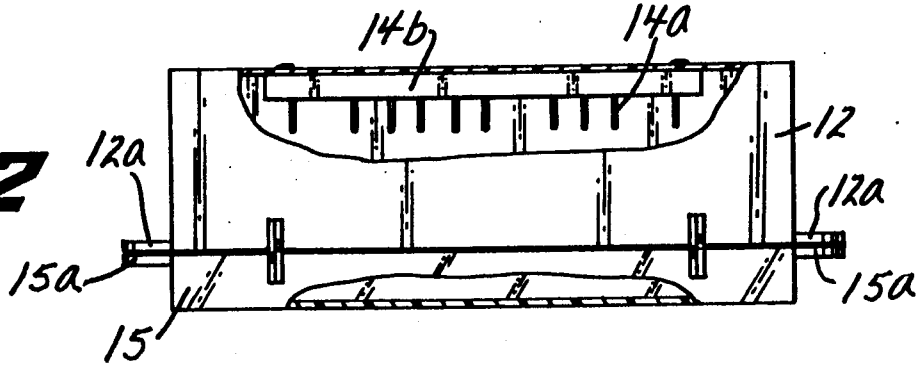
FIG. 2 is a top plan view of the safety box of FIG. 1, looking downwardly in such figure.

Base 12 and lid 15 each include an outwardly extending flange **12*a* and 15*a*, respectively, containing spaced-apart aligned openings 17' (see FIGS. 1 and 2). Centrally disposed projections 12*b* and 15*b*, also presenting aligned openings 17*c'*, form part of the peripheral edges of the base 12 and the lid 15, serving to receive a lock 20 (see FIGS. 1 and 3**).

The lid 15 presents a see-through window **15*c* for observing a key or keys K within the safety box. With the lock 20** in position, access to any key K is prohibited, meaning that a supervisor or other responsible person has control of the operation of the equipment under maintenance/repair, i.e. no one else has access to a key or keys which may serve operation purposes and all personnel are accountable (by tags T).

Thus, the openings 17' further identify workers on the equipment. In other words, complete operation of the equipment is precluded and, as well, the number of other workers involved at the equipment site is readily known.

Thus, when no locks or tags T are visible, the supervisor is aware that the equipment is not involved with a maintenance/repair operation and, accordingly, lock 20 can be released, permiting access to the key K so that complete equipment functioning can be initiated.

Thus, and in a direct approach, the safety box of the invention simplifies control of manufacturing equipment, i.e. readily indicates the presence and/or absence of personnel.

The safety box described above is susceptible to various changes within the spirit of the invention, including, by way of example, in proportioning; in the location and/or configuration of the see-through window in the lid; the number of corresponding openings in the peripheral edges of the base and the lid; the precise approach of positioning and the type of keys within the box; and, the like.

Thus, the preceding should be considered illustrative and not as limiting the scope of the following claims.

I claim:

1. A safety container for storing at least one key therein, which key is used to render power driven machinery operative, said container comprising a base defining a storage cavity therein, a lid which is transparent on at least a portion thereof and which is pivotally attached to said base, for selectively opening and closing said cavity and for permitting viewing of the contents of said cavity therethrough when said lid is closed against said base such that said cavity is closed, means disposed in said cavity for supporting at least one key thereon so as to be viewable through said transparent portion when said lid is closed against said base, a first flange attached to and along at least a portion of the periphery of said lid and projecting outwardly therefrom, a second flange attached to and along at least a portion of the periphery of said base and projection outwardly therefrom, said first and second flanges lying in registry with one another when said lid is closed against said base, said first and second flanges each defining a plurality of spaced apart apertures, the plurality of apertures in one of said flanges registering with the plurality of apertures in the other of said flanges when said lid is closed against said base such that an identification member can be inserted through any one pair of registered apertures to secure said lid against said base.

2. The safety container of claim 1 wherein said base is box shaped and comprises a rectangularly shaped rear wall, four sidewalls and a rectangularly shaped frontal opening, said lid being rectangularly shaped.

3. The safety container of claim 1 wherein said lid is transparent over its entire cavity covering surface.

4. The safety container of claim 2 wherein said aperture containing first and second flanges are attached to and extend along three sides of said lid and base, respectively.

5. The safety container of claim 2 wherein said key supporting means comprises a support member attached to said rear wall, and a series of spaced apart hooks attache to said support member.

6. The safety container of claim 4 wherein each of said flanges further includes a centrally disposed projection which projects outwardly from its corresponding flange, both of which projections register with one another when said lid is closed against said base and which define central apertures therethough which are offset outwardly from said pluralities of apertures and which central apertures register with one another when said lid is closed against said base such that said central apertures can receive a lock to prevent unauthorized entry into said container.

7. The safety container of claim 5 wherein said hooks are straight.

* * * * *